US008021228B2

(12) United States Patent
Jaffe

(10) Patent No.: US 8,021,228 B2
(45) Date of Patent: Sep. 20, 2011

(54) WAGERING GAME WITH ACTIVE PAYTABLE HIGHLIGHTING WINNING COMBINATIONS

(75) Inventor: Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 299 days.

(21) Appl. No.: 12/446,716

(22) PCT Filed: Oct. 29, 2007

(86) PCT No.: PCT/US2007/022854

§ 371 (c)(1),
(2), (4) Date: Apr. 22, 2009

(87) PCT Pub. No.: WO2008/057325

PCT Pub. Date: May 15, 2008

(65) Prior Publication Data

US 2009/0280890 A1 Nov. 12, 2009

Related U.S. Application Data

(60) Provisional application No. 60/856,078, filed on Nov. 2, 2006.

(51) Int. Cl.
*A63F 9/24* (2006.01)

(52) U.S. Cl. ..... 463/20; 463/25

(58) Field of Classification Search ..... 463/16–22, 463/25–30; 273/143 R, 292, 138.1, 139
See application file for complete search history.

(56) References Cited

U.S. PATENT DOCUMENTS 5,766,074 A 6/1998 Cannon et al. ..... 463/16

(Continued)

FOREIGN PATENT DOCUMENTS

WO WO 2004/079668 A2 9/2004

(Continued)

OTHER PUBLICATIONS

PCT International Search Report for International Application No. PCT/US2007/022854 dated Apr. 21, 2008 (2 pages).

(Continued)

*Primary Examiner* — Masud Ahmed
(74) *Attorney, Agent, or Firm* — Nixon Peabody LLP

(57) ABSTRACT

A gaming machine for playing a wagering game includes a game display, a display arrangement, and a controller. The game display is operable to display a randomly selected outcome of a wagering game in response to receiving a wager from a player. The display arrangement displays a video image and overlays the game display. The video image includes a paytable having paytable regions indicating respective winning combinations. The controller is in communication with the display arrangement, wherein in response to the randomly selected outcome including symbols of a winning symbol combination, the controller causes one or more aspects of the paytable region associated with the winning combinations to be distinguished from the other paytable regions.

20 Claims, 7 Drawing Sheets

U.S. PATENT DOCUMENTS

| | | | | |
|---|---|---|---|---|
| 5,984,779 | A * | 11/1999 | Bridgeman et al. | 463/16 |
| 6,319,124 | B1 | 11/2001 | Baerlocher et al. | 463/20 |
| 6,634,946 | B1 * | 10/2003 | Bridgeman et al. | 463/28 |
| 6,695,696 | B1 | 2/2004 | Kaminkow | 463/16 |
| 6,890,254 | B2 | 5/2005 | Kaminkow | 463/16 |
| 6,896,615 | B2 * | 5/2005 | Berman | 463/20 |
| 6,939,223 | B1 | 9/2005 | Jones | 463/16 |
| 6,964,609 | B2 | 11/2005 | Haag et al. | 463/20 |
| 7,066,811 | B1 | 6/2006 | DeFrees-Parrott et al. | 463/19 |
| 7,481,710 | B2 | 1/2009 | Kaminkow | 463/31 |
| 2004/0198485 | A1 * | 10/2004 | Loose et al. | 463/20 |
| 2005/0014547 | A1 | 1/2005 | Gomez et al. | 463/16 |
| 2005/0130731 | A1 | 6/2005 | Englman et al. | 463/20 |
| 2005/0282638 | A1 * | 12/2005 | Rowe | 463/42 |

FOREIGN PATENT DOCUMENTS

| | | | |
|---|---|---|---|
| WO | WO 2006/036948 | A2 | 4/2006 |

OTHER PUBLICATIONS

PCT Written Opinion for International Application No. PCT/US2007/022854 dated Apr. 24, 2008 (5 pages).

* cited by examiner

WAGERING GAME WITH ACTIVE PAYTABLE HIGHLIGHTING WINNING COMBINATIONS

CROSS REFERENCE TO RELATED APPLICATIONS

This application is a U.S. national stage of International Application No. PCT/US2007/022854, filed Oct. 29, 2007, which is related to and claims priority to U.S. Provisional Application No. 60/856,078, filed Nov. 2, 2006, which is incorporated herein its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a transmissive display showing an active paytable.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Recent advances in transmissive display technology have made it possible to more easily modify the appearance of a mechanical display. The transmissive display is essentially a transparent video display that is superimposed over the mechanical display. The transmissive display is then operated to display selected video images superimposed over the mechanical display. The video images may include translucent portions so that the underlying mechanical display is visible, but in an altered state (i.e., different color, texture, etc.). The video images may also include opaque portions so as to completely block out the underlying mechanical display. For information regarding the use of transmissive display technology in gaming machines and for embodiments employing transmissive displays, the reader is referred to commonly-assigned U.S. Published Application No. 20040198485, titled "Gaming Machine with Superimposed Display Image," filed on Nov. 7, 2003, and to commonly-assigned U.S. Pat. No. 6,517,433, titled "Reel Spinning slot Machine With Superimposed Video Image," issued on Feb. 11, 2003, each of which being incorporated herein by reference in its entirety.

The above-described transmissive display technology gives wagering game designers the capability and flexibility to more easily design and modify the appearance of mechanical displays. Accordingly, there is a need to develop new and improved wagering games for mechanical displays using this technology, with features that take full advantage of the capabilities of the transmissive display to thereby enhance the entertainment value of the wagering games.

SUMMARY OF THE INVENTION

According to one aspect of the present invention, a gaming machine for playing a wagering game includes a game display, a display arrangement, and a controller. The game display is operable to display a randomly selected outcome of a wagering game in response to receiving a wager from a player. The display arrangement displays a video image and overlays the game display. The video image includes a paytable having paytable regions indicating respective winning combinations. The controller is in communication with the display arrangement, wherein in response to the randomly selected outcome including symbols of a winning symbol combination, the controller causes one or more aspects of the paytable region associated with the winning combinations to be distinguished from the other paytable regions.

According to another aspect of the invention, a method of conducting a wagering game includes receiving a wager input from a player for playing the wagering game and displaying on a game display a randomly selected outcome of a plurality of outcomes. A video image is overlaid over the game display and a paytable is displayed on the video image. The paytable has paytable regions indicative of respective winning combinations. The method further includes distinguishing one or more aspects of an applicable one of the paytable regions when a corresponding winning combination is achieved on the game display.

According to yet another aspect of the invention, a computer readable storage medium is encoded with instructions for directing a gaming system to perform the above method.

According to yet another aspect of the invention, a gaming system for conducting a wagering game includes a game display having a plurality of reels, a display arrangement for displaying a video image overlaying the game display, and a controller communicatively coupled to the display arrangement. The game display indicates via reel symbols a randomly selected outcome of the wagering game. The video image includes a paytable having a plurality of paytable regions. The controller causes a change of an aspect of a corresponding paytable region from an inactive mode to a first mode, based on a first winning combination, and a change of the aspect from the first active mode to a second active mode, based on a second winning combination.

Additional aspects of the invention will be apparent to those of ordinary skill in the art in view of the detailed description of various embodiments, which is made with reference to the drawings, a brief description of which is provided below.

DETAILED DESCRIPTION

Figure 1:
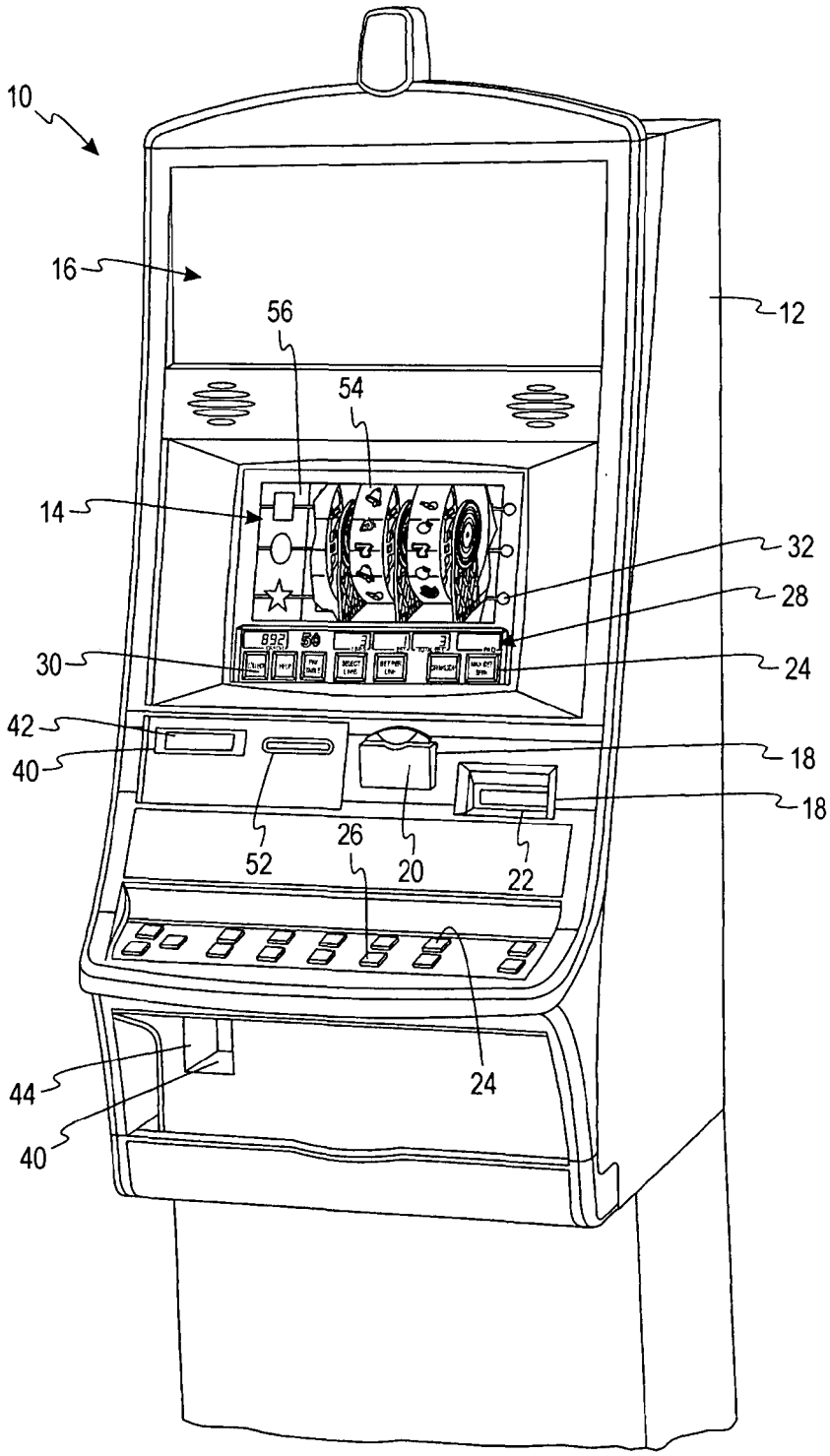
FIG. 1 is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a mechanical reel gaming machine 10 similar to those used in gaming establishments, such as casinos, is shown. The gaming machine 10 comprises a housing 12 and a number of input devices, including a value input device 18 and a player input device 24. For outputs, the gaming machine 10 comprises a primary display area 14 for displaying information about base wagering games and a secondary display area 16 for displaying game events, game outcomes, and/or signage information. The primary display area 14 and/or secondary display area 16 may also display information about bonus wagering games and progressive wagering games. In accordance with embodiments of the invention, the primary display area 14 comprises a plurality of mechanical reels 54 and a transmissive display 56 superimposed over the mechanical reels 54. Each of the foregoing components is described in more detail below. While the exemplary embodiments described below refer to the mechanical reels 54, in other embodiments the mechanical reels 54 can be replaced with video reels 54' (see FIG. 3). Thus, alternatively, the primary display area 14 can include the transmissive display 56 being superimposed over a plurality of video reels 54.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency. Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like on the primary display area 14 (over the transmissive display 56) and/or on secondary display area 16. The touch screen 28 contains soft touch keys 30 denoted by graphics on the underlying primary display area 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

A player begins play of the base wagering game by making a wager via the value input device 18 of the gaming machine 10. A player can select play by using the player input device 24, via the buttons 26 or the touch screen keys 30. The base game consists of a plurality of symbols arranged in an array, and includes at least one payline 32 that indicates one or more outcomes of the base game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display area 16 or other dedicated player-tracking display for providing the player with information about his or her account or other player-specific information. Also, in some embodiments, the information reader 52 may be used to restore game assets that the player achieved and saved during a previous game session.

In the illustrated embodiment, the gaming machine 10 is an "upright" version in which the primary display area 14 is oriented vertically relative to the player. Alternatively, the gaming machine may be a "slant-top" version in which the primary display area 14 is slanted at about a thirty-degree angle toward the player of the gaming machine 10. Furthermore, although only three mechanical reels are shown in the primary display area 14, those having ordinary skill in the art will recognize that the gaming machine 10 may comprise fewer or more mechanical reels (e.g., four reels, five reels, etc.), depending on the particular configuration of the primary display area 14.

Figure 2A:
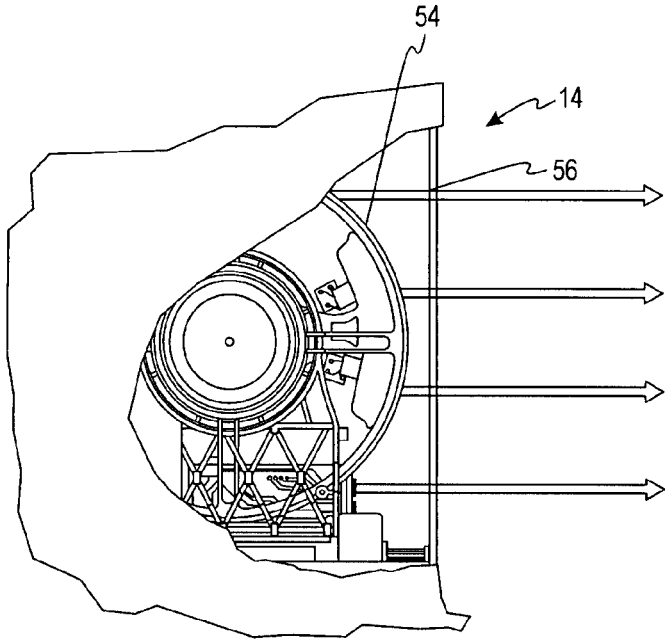
FIGS. 2*a*-2*b* are cross-sectional side views of a display area embodying the present invention.
Figure 2B:
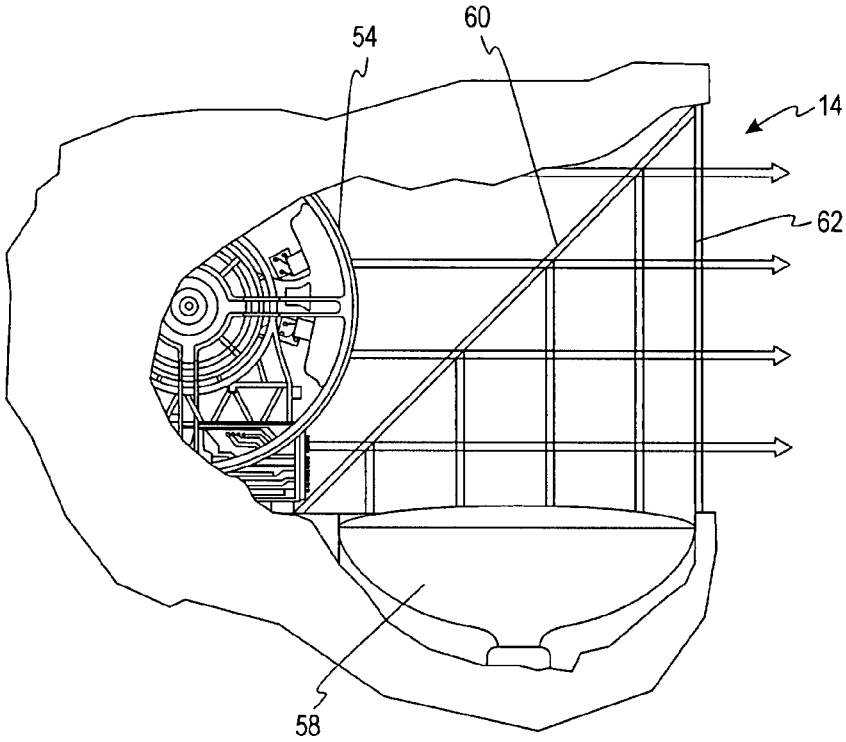

FIGS. 2*a*-2*b* illustrate exemplary implementations of the primary display area 14 in which a video image is superimposed over the mechanical reels 54. Although not expressly labeled, each reel of the mechanical reels 54 has a plurality of reel symbols (see FIG. 1) that represent a randomly-selected outcome of the wagering game. The video image may then be positioned over the mechanical reels 54 to enhance and/or alter the appearance (e.g., color, texture, etc.) of the mechanical reels 54. There are at least two possible configurations for the primary display area 14: a direct image configuration (FIG. 2*a*), and a virtual image configuration (FIG. 2*b*). These configurations are described below.

Referring to FIG. 2*a*, in the direct image configuration, a transmissive display 56 is positioned directly in front of the mechanical reels 54 and generates a direct image. In such an arrangement, the transmissive display 56 may be a flat panel transmissive video display, for example, a transmissive liquid crystal display (LCD) commercially available from LG Phillips LCD Co., Ltd., of Seoul, Korea, Sharp Electronics Corp. of Tokyo, Japan, and other display manufacturers. The flat panel transmissive video display is preferably preconfigured with the touch screen 28 (see FIG. 1) mounted to a front surface of the display.

In the virtual image configuration, shown in FIG. 2*b*, a reflected video image is used instead of a direct image. In such an arrangement, the reflected video image may be generated by, for example, a standard video display 58 and a partially reflective mirror 60. The standard video display 58 may be mounted below the mechanical reels 54 and substantially normal thereto, and the partially reflective mirror 60 may be positioned over the mechanical reels 54 at a predetermined angle (e.g., 45 degrees). Video images from the standard video display 58 are then reflected off the partially reflective mirror 60 so that they appear to a player to be superimposed over the mechanical reels 54. The standard video display 58 may be any suitable video projection display known to those having ordinary skill in the art, including a CRT, LCD, dot matrix, LED, electro luminescent, and the like. In some embodiments, the primary display area 14 further comprises a transparent glass cover/window 62 positioned over the partially reflective mirror 60 to protect the mirror 60. Such a cover/window 62 may be optionally configured with the touch screen 28 for receiving player input.

The superimposed video images may be selectively made transparent, semi-transparent (i.e., translucent), or opaque in selected places. This allows preselected images to be displayed over certain portions of the primary display area 14, with the result that certain areas of the primary display area 14 are either altered in some way (e.g., highlighted, colored, etc.), or completely blocked by the superimposed images. All video images superimposed on the primary display area 14 may be rendered in two-dimensional (e.g., using Flash Macromedia™) or three-dimensional graphics (e.g., using Renderware™). The images may be played back (e.g., from a recording stored on the gaming machine 10), streamed (e.g., from the gaming network), or received as a TV signal (e.g., either broadcast or via cable). The images may be animated, or they may be real-life images, either prerecorded (e.g., in the case of marketing/promotional material) or as live footage, and the format of the video images may be an analog format, a standard digital format, or a high-definition (HD) digital format. Using superimposed video images in this way allows numerous types of improvements and enhancements to be made to the appearance of the primary display area 14 in real time and during on-going game play.

Figure 3:
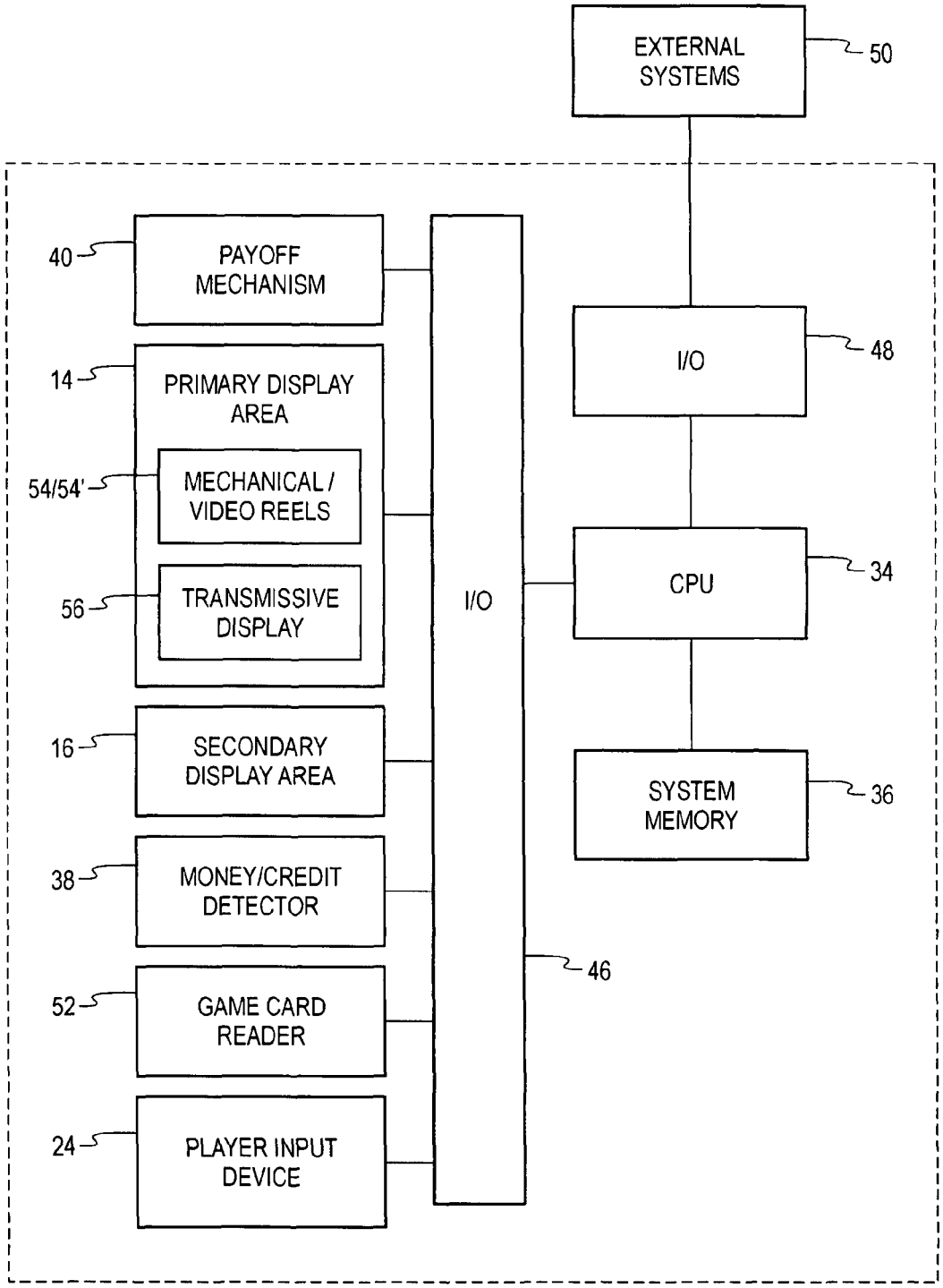
FIG. 3 is a block diagram of a control system suitable for operating the gaming machine of FIG. 1.

Turning now to FIG. 3, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10, but may be located outboard of the housing 12 and connected to the remainder of the components of the gaming machine 10 via a variety of different wired or wireless connection methods.

As seen in FIG. 3, the controller 34 is also connected to, and controls, the primary display area 14, the player input device 24, and a payoff mechanism 40. The primary display area 14 in this embodiment uses the transmissive display 56 to superimpose a video image over the mechanical/video reels 54/54', but a reflected image arrangement (see FIG. 2*b*) may also be used in other embodiments. The payoff mechanism 40 is operable in response to instructions from the controller 34 to award a payoff to the player in response to certain winning outcomes that might occur in the base game or the bonus game(s). The payoff may be provided in the form of points, bills, tickets, coupons, cards, and the like. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, and the like. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 3, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10.

By virtue of the superimposed video images, a variety of traditional as well as visually-enhanced wagering games involving the mechanical reels 54 may be played on the gaming machine 10. These wagering games may be provided to the gaming machine 10 using any suitable means known to those having ordinary skill in the art, including hardware upgrades as well as direct downloads via external systems 50. In the latter case, the gaming machine 10 may communicate with the external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. Numerous alternative configurations are possible such that the aforementioned and other functions may be performed onboard or external to the gaming machine 10 as may be necessary for particular applications.

Thus far, the transmissive display 56 has only been described as being part of the primary display area 14. It is also possible, however, to position the transmissive display 56 in the secondary display area 16 as well without departing from the scope of the invention. Still, in most embodiments, the primary display area 14 is the one with the transmissive display 56 being directly positioned to generate a direct image. The reason for this is because in gaming machines 10 that involve the transmissive display 56, most of the time the primary display area 14 is the one that includes mechanical reels (e.g., for a slot machine), a mechanical wheel (e.g., a roulette game), one or more dice, a pachinko board, or other board game. In alternative embodiments, however, the primary display area 14 may include video reels 54' by using a video display such as a CRT or LCD. In further alternative embodiments, the primary display area 14 may include a diorama presenting a three-dimensional model of a game environment. The diorama may be stationary in some implementations, or it may slide or move around in one or more dimensions.

Figure 4:
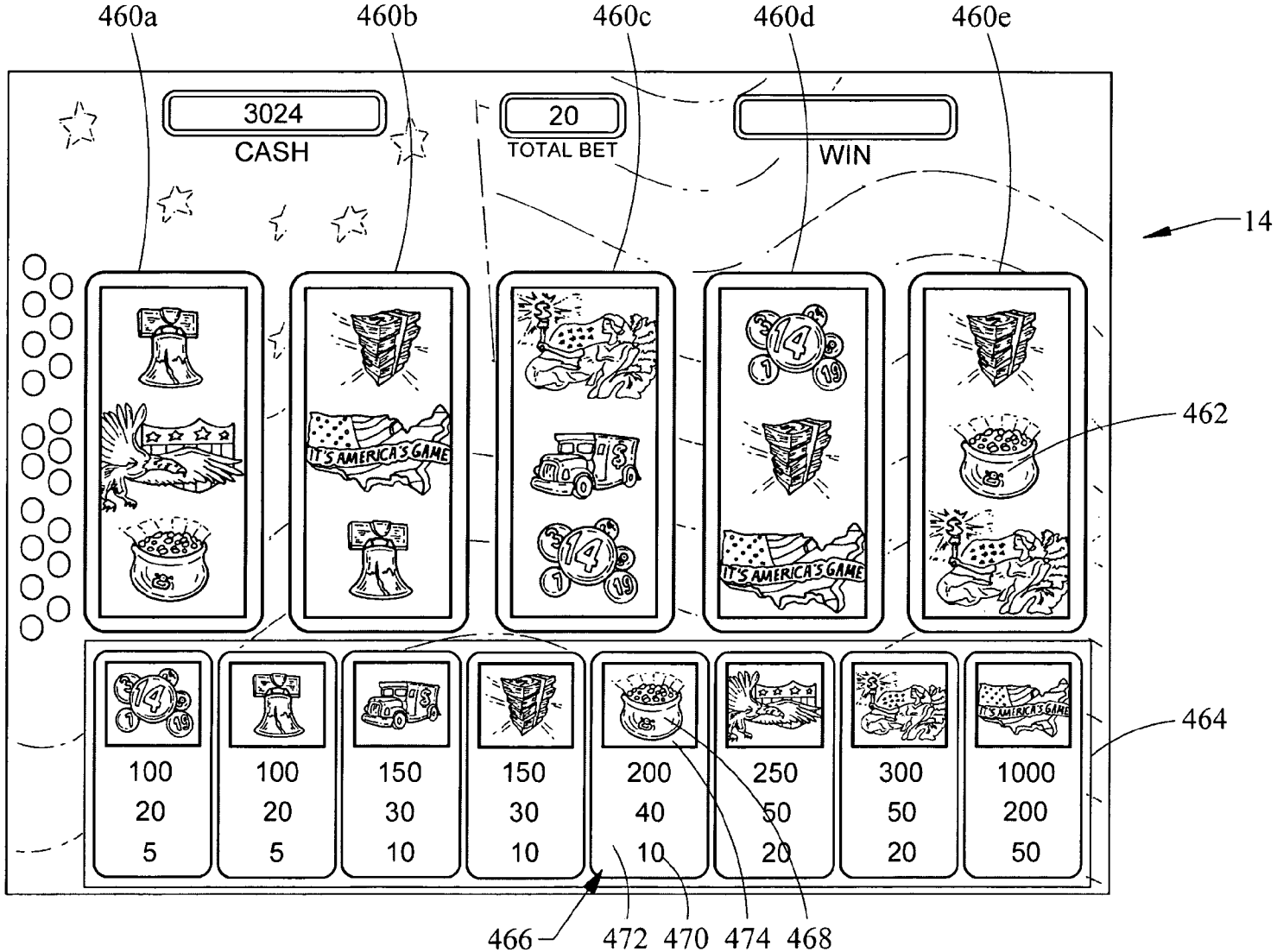
FIG. 4 is a front view of a display area of the gaming machine showing video images of an active paytable superimposed on mechanical reels, according to an embodiment of the invention.

Referring to FIG. 4, the primary display area 14 includes a plurality of reels 460*a*-460*e*, which include a plurality game symbols 462. The reels 460*a*-460*e* can be mechanical reels or video reels. In response to receiving a wager, the reels 460*a*-460*e* start spinning and, then, either generally simultaneously or sequentially they stop spinning to indicate a particular combination of the game symbols 462. As shown, the reels 460*a*-460*e* are displayed in a stopped position prior to beginning a spinning motion.

The primary display area 14 further includes a paytable 464 having a plurality of winning symbol areas 466, which are indicative of a plurality of awards (e.g., credits, mystery awards, bonus games, progressive jackpots, etc.). Each of the winning symbol areas 466 includes a winning symbol 468, a plurality of award numerals 470 (also referred to as "awards"), an area background box 472, and a symbol background box 474.

In the illustrated embodiment, the award numerals 470 indicate the respective number of credits that are awarded when a corresponding winning combination is achieved along an active payline. As explained below, according to an exemplary embodiment, a winning combination is achieved when three or more game symbols 462 that are aligned along an active payline match at least one of the winning symbols 468. According to an exemplary central payline, symbols are required to be aligned along each middle symbol of the reels 460*a*-460*e* (e.g., the eagle symbol 462, the map symbol 462, the truck symbol 462, the cash stack symbol 462, and the gold pot symbol 462 in FIG. 4).

The paytable 464 shows three award numerals 470 for each one of the winning symbols 468. An initial award numeral 470 of "10" indicates that ten credits are awarded if the player achieves three winning symbols 468. A greater award numeral 470 of "40" indicates that forty credits are awarded if the player achieves four winning symbols 468. A large award numeral 470 of "200" indicates that two hundred credits are awarded if the player achieves five winning symbols 468. In alternative embodiments, any award numeral 470 can be associated with any number of winning symbols 468 for awarding one or more awards, including credits, mystery awards, bonus games, progressive jackpots, etc.

The paytable 464 is displayed on the transmissive display 56 of the primary display area 14 and the reels 460*a*-460*e* are displayed on the mechanical reels 54 of the primary display area 14. The winning symbol areas 466 are initially shown in a standard inactive mode. In the inactive mode, the winning symbol areas 466 are displayed generally similar to each other such that none is more emphasized than another. For example, the winning symbols 468 are all displayed having the same size and brightness, and the award numerals 470 are all displayed having the same size, same font, and same brightness. Similarly, the area background boxes 472 are all displayed having the same size and shape, and the symbol background boxes 474 are all displayed having the same size, shape and color.

Figure 5:
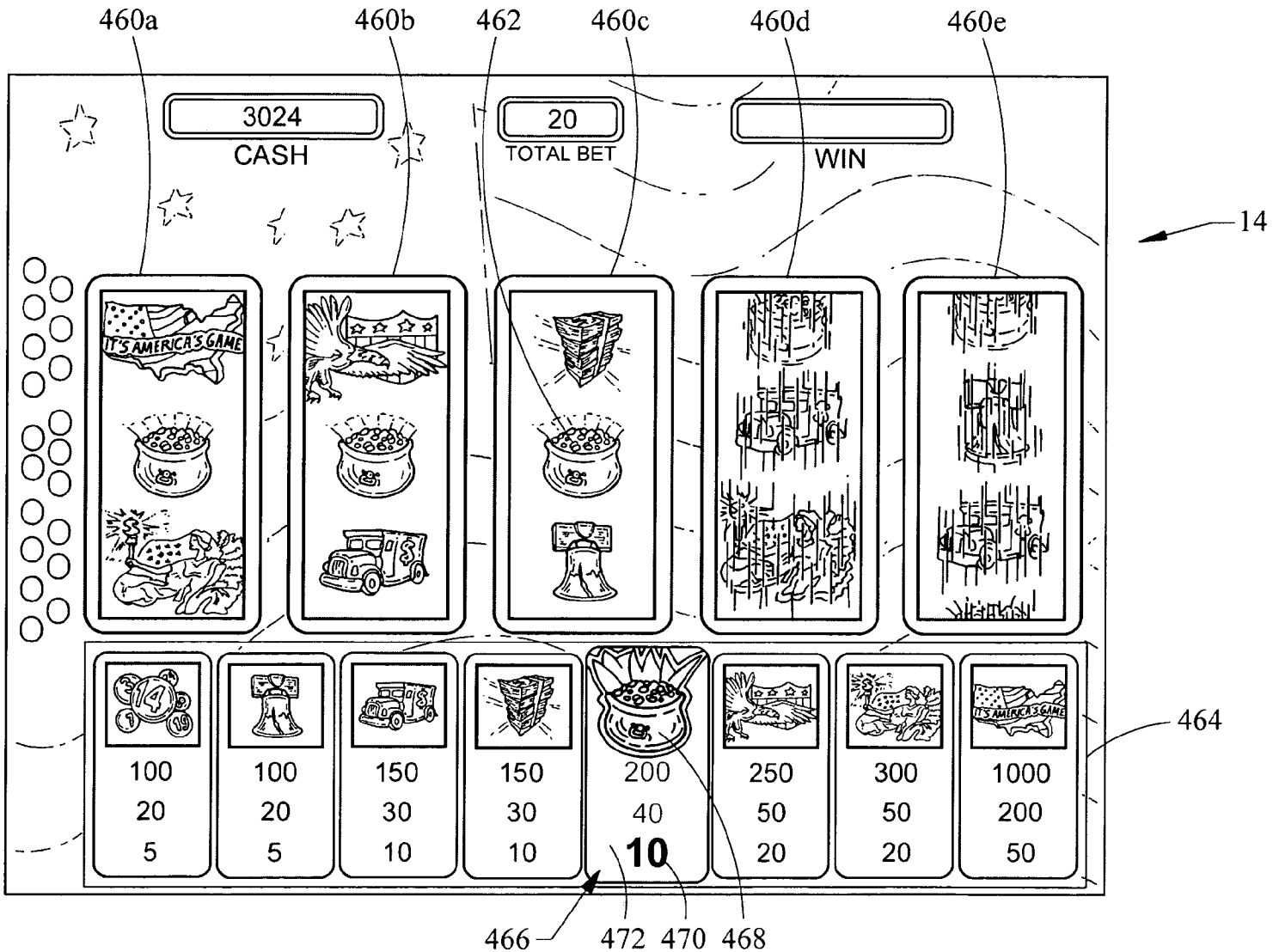
FIG. 5 shows a first active mode of a winning combination of the paytable, according to an alternative embodiment of the invention.

Referring to FIG. 5, in response to receiving the wager from the player, the reels 460*a*-460*e* have been set in the spinning motion. The displayed time sequence of the reels 460*a*-460*e* represents the first three reels 460*a*-460*c* stopped, while the last two reels 460*d*-460*e* are continuing their spinning motion. As shown, a gold pot symbol 462 is aligned in each of the first three reels 460*a*-460*c* along the exemplary central payline, which the player's wager has activated. The player may typically activate more paylines with a higher wager.

The achievement of the three gold pot symbols 462 triggers a corresponding active mode in the particular winning symbol area 466 of the paytable 464 that is associated with the gold pot symbols 462. The corresponding active mode includes showing with emphasis the gold pot winning symbol 468, the award numeral 470 of "10" credits, and the area background box 472. The emphasis of the gold pot winning symbol 468 includes showing a larger and brighter symbol than shown in the inactive mode. The emphasis of the award numeral 470 includes showing a larger and brighter numeral "10" than the numeral "10" shown in the inactive mode. The emphasis of the area background box 472 includes enlarging it relative to the one shown in the inactive mode. The symbol background box 474 has been removed for emphasis purposes.

The player's anticipation and level of excitement is likely greatly increased when the paytable is activated. The active mode associated with the particular winning combination stimulates the player's excitement that he or she has just won an award. Optionally, an audio sound can be provided to further enhance the player's excitement when winning an award.

Figure 6:
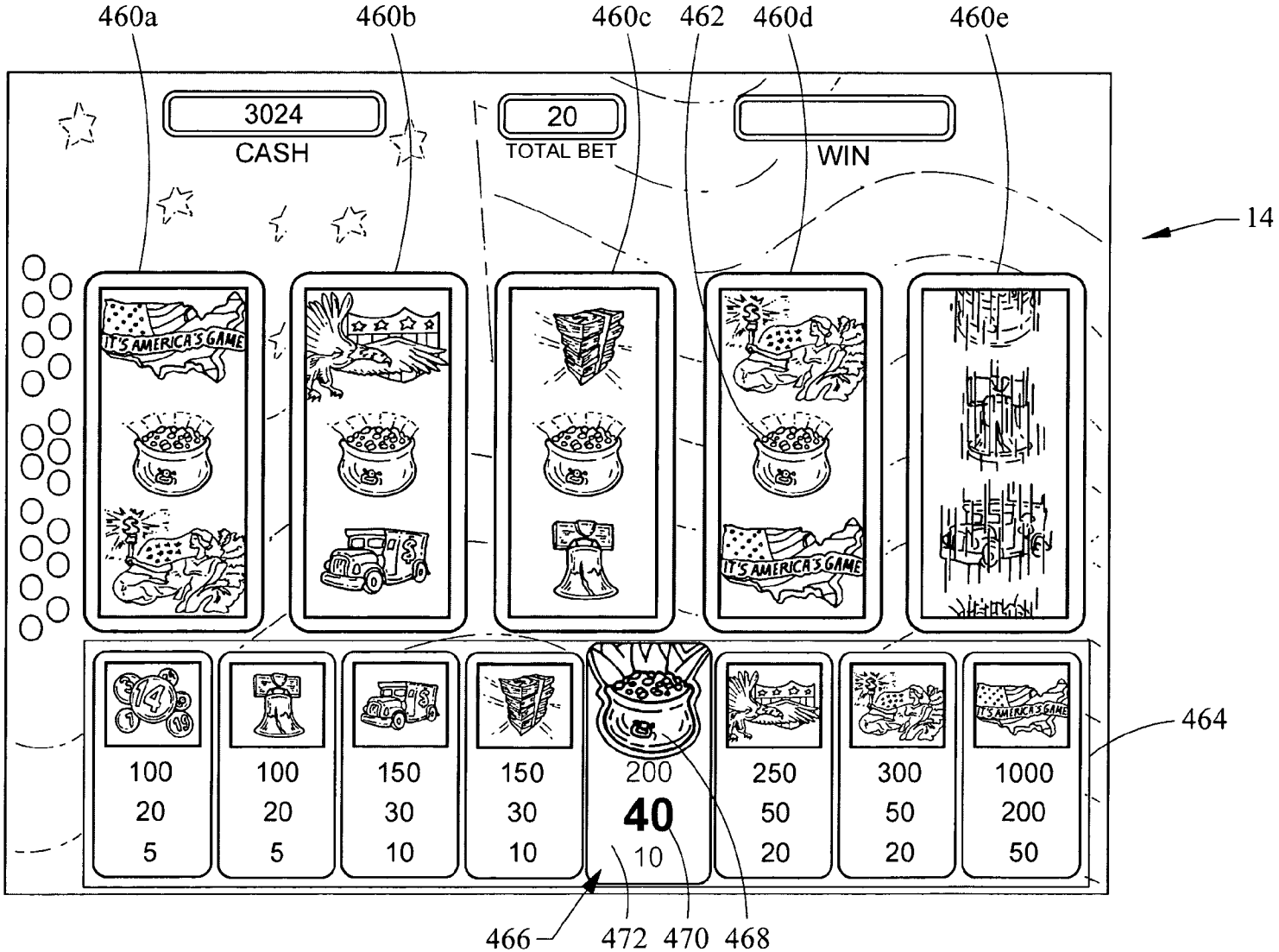
FIG. 6 shows a second active mode of the winning combination, according to another alternative embodiment of the invention.

Referring to FIG. 6, the time sequence of the spinning reels 460*a*-460*e* now represents a fourth reel 460*d* stopped, while the fifth reel 460*d* remains in a spinning motion. A gold pot game symbol 462 is located in the central location of the fourth reel 460*d*, aligned along the exemplary central payline. Consequently, the award numeral 470 of "40" credits is now highlighted, or emphasized, in a corresponding active mode of the paytable 464. The award numeral 470 of "40" credits is displayed having a larger and brighter font than the corresponding numeral displayed in the inactive mode. Further, the award numeral 470 of "40" is displayed having a larger and brighter font than the corresponding numeral displayed in the active mode associated with the award numeral 470 of "10" credits (displayed in FIG. 5). Thus, a proportional increase in emphasis is shown in accordance with the number of awarded credits.

The active mode associated with the award of "40" credits also displays with emphasis the gold pot winning symbol 468 and the area background box 472. Specifically, the gold pot winning symbol 468 has now increased in size relative to the size displayed in the active mode associated with the award of "10" credits. Also, the size of the area background box 472 has increased in size relative to the size displayed in the active mode associated with the award of "10" credits.

Figure 7:
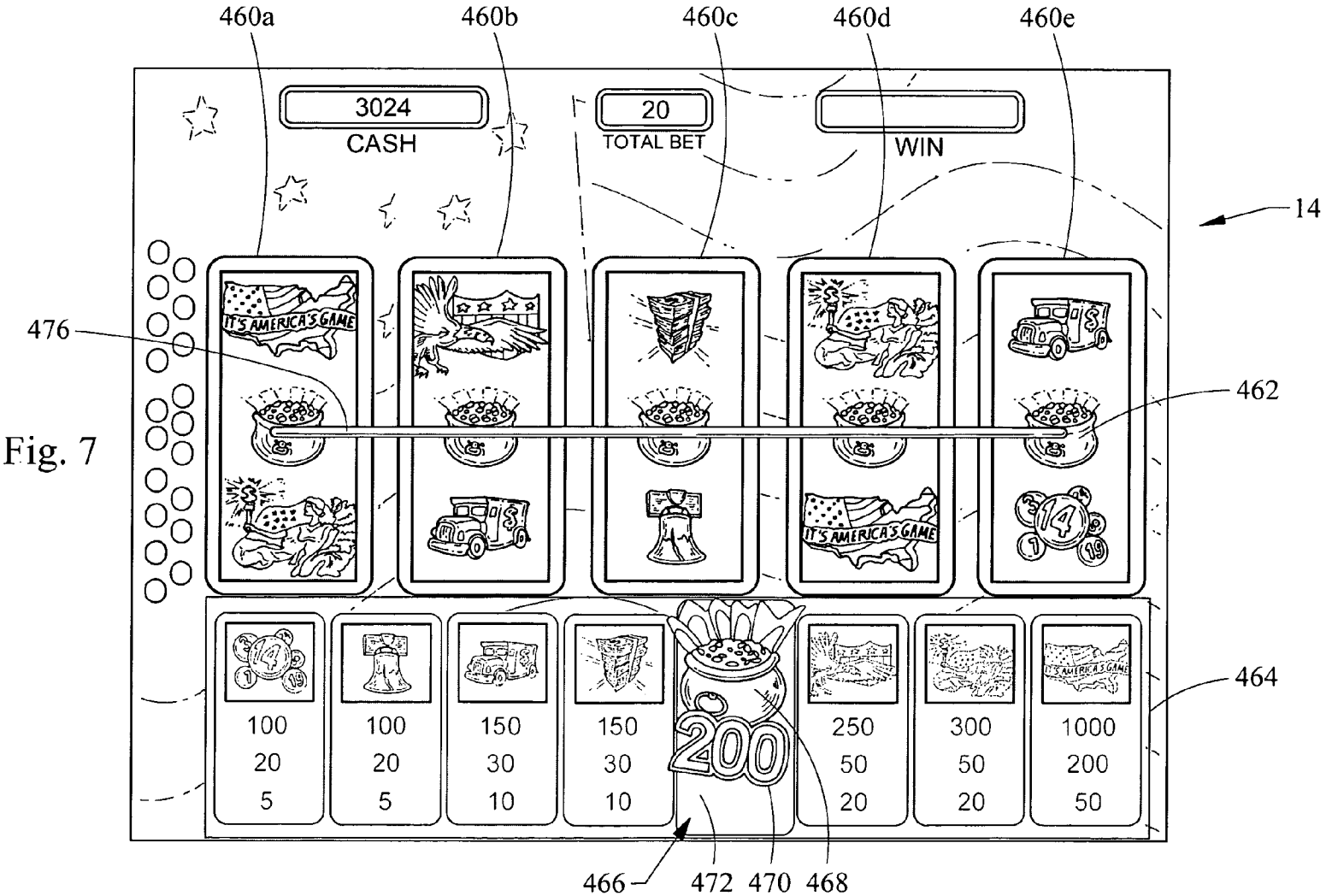
FIG. 7 shows a third active mode of the winning combination, according to another alternative embodiment of the invention.

Referring to FIG. 7, the time sequence of the spinning reels 460*a*-460*e* now represents all of the reels 460*a*-460*e* as being stopped. A fifth gold pot game symbol 462 is now aligned along the exemplary central payline. Thus, the player has won a "200" credit award in accordance with achieving five gold pot game symbols 462 corresponding to the gold pot winning symbol 468. The active mode of the corresponding winning symbol area 466 now shows an increase in size and brightness of the gold pot winning symbol 468, the award numeral 470, and the area background box 472. In addition, the numerals "10" and "40" have been removed and the font color of the numeral "200" has changed (i.e., changed from a gray color to a blue color). Further emphasis has been provided by graying-out all the other winning symbol areas 466.

On the reels 460*a*-460*e*, the five gold pot game symbols 462 are displayed with a line 476 drawn through each one for distinguishing the winning combination. The line 476 emphasizes the winning combination so that the player can easily notice the particular winning combination of game symbols 462.

Optionally, the paytable 464 and/or the winning combination of game symbols 462 can use other visual and/or audio features to emphasize a player award. For example, an active mode of the paytable 464 can include a video animation (e.g., a display of exploding fireworks, a dancing animal, etc.) and/or audio sounds (e.g., a musical soundtrack, a voice announcement, etc.). Transmissive displays could show a direct line or stars leading from the actual location of the winning combination (above the paytable 464) to the paytable 464. Optionally, transmissive displays could be used to highlight the region over the winning payline (through the winning symbol combination) in a specific color and then highlight the background area 472 in the same color as the winning payline. This would help when multiple wins may occur at the same time on different active paylines.

Each of these embodiments and obvious variations thereof is contemplated as falling within the spirit and scope of the claimed invention, which is set forth in the following claims.

What is claimed is:

1. A gaming machine for playing a wagering game, comprising:

a game display operable to display a randomly selected outcome of a wagering game in response to receiving a wager from a player;

a display arrangement for displaying a video image including a paytable having a plurality of paytable regions indicating respective winning combinations, the paytable being displayed separate from the randomly selected outcome and displaying possible winning symbol combinations that can be achieved in the randomly selected outcome of the wagering game; and a controller in communication with the display arrangement the and operative to distinguish in the video image a first mode of a paytable region in response to (a) displaying a partial state of the randomly selected outcome of the wagering game and (b) achieving a first winning symbol combination corresponding to the paytable region, and replace the first mode with a second mode of the paytable region (c) prior to or upon displaying a full state of the randomly selected outcome of the wagering game, and (d) in response to achieving a second winning symbol combination corresponding to the paytable region.

2. The gaming machine of claim 1, wherein the game display includes a plurality of mechanical reels.

3. The gaming machine of claim 1, wherein the display arrangement includes a transmissive display and a touch screen adjacent to the transmissive display.

4. The gaming machine of claim 1, wherein the randomly selected outcome of the wagering game is indicated on a plurality of reels, the partial state of the randomly selected outcome being indicated before all the reels have stopped spinning.

5. The gaming machine of claim 1, wherein the first mode and the second mode each show a symbol indicative of a respective award, the symbol corresponding to the first mode being smaller than the symbol corresponding to the second mode.

6. The gaming machine of claim 1, wherein the game display shows a plurality of game symbols indicative of the randomly selected outcome, the controller causing winning game symbols of the game symbols to be emphasized.

7. A gaming machine for playing a wagering game, comprising:

a game display operable to display a randomly selected outcome of a wagering game in response to receiving a wager from a player;

a display arrangement for displaying a video image overlaying the game display, the video image including a paytable having paytable regions indicating respective winning combinations; and a controller in communication with the display arrangement and operative to distinguish in the video image a first mode of a paytable region in response to (a) displaying a partial state of the randomly selected outcome of the wagering game and (b) achieving a first winning symbol combination corresponding to the paytable region, and replace the first mode with a second mode of the paytable region (c) prior to or upon displaying a full state of the randomly selected outcome of the wagering game, and (d) in response to achieving a second winning symbol combination corresponding to the paytable region.

8. The gaming machine of claim 7, wherein the second mode shows a linear progression relative to the first mode that is indicative of the number of credits awarded for a respective winning combination.

9. A method of conducting a wagering game, comprising:

receiving a wager input, at a value input device, from a player for playing the wagering game;

displaying on a game display a randomly selected outcome of a plurality of outcomes;

using one or more controllers to display a paytable on the video image, the paytable having a plurality of paytable regions indicative of respective winning symbol combinations, the paytable being displayed separate from the randomly selected outcome and displaying possible winning symbol combinations that can be achieved in the randomly selected outcome of the wagering game;

distinguishing, by at least one of the controllers, in the video image a first mode of a paytable region in response to (a) displaying a partial state of the randomly selected outcome and (b) achieving a first winning symbol combination corresponding to the paytable region; and replacing, by at least one of the controllers, the first mode with a second mode of the paytable region (c) prior to or upon displaying a full state of the randomly selected outcome, and (d) in response to achieving a second winning symbol combination corresponding to the paytable region.

10. The method of claim 9, further comprising accepting a player selection via a touch screen.

11. The method of claim 9, wherein the distinguishing step includes emphasizing the or more aspects of the paytable region, and further comprising deemphasizing one or more of other ones of the plurality of paytable regions when a winning combination corresponding to the one or more of the other ones of the plurality of paytable regions does not occur.

12. The method of claim 9, further comprising changing the distinguishing of the paytable region based on the amount of the corresponding winning symbol combination.

13. The method of claim 12, wherein the changing step includes increasing emphasis on one or more aspects of the paytable region in accordance with an increase in an award of the corresponding winning symbol combination.

14. The method of claim 9, further comprising, in response to indicating one of the respective winning symbol combinations, showing an emphasis of a plurality of game symbols that are indicative of the one of the respective winning symbol combinations.

15. A computer-readable storage medium encoded with instructions for directing a gaming machine to implement the method of claim 9.

16. A gaming system for conducting a wagering game, comprising:

a game display having a plurality of reels and indicating via reel symbols on the plurality of reels a randomly selected outcome of the wagering game;

a display arrangement for displaying a video image including a paytable having a plurality of paytable regions, the paytable being displayed separate from the randomly selected outcome and displaying possible winning symbol combinations that can be achieved in the randomly selected outcome of the wagering game; and a controller communicatively coupled to the display arrangement, the controller being operative to distinguish in the video image a first mode of a paytable region (a) before all reels of the plurality of reels stop spinning and (b) in response to achieving a first winning symbol combination corresponding to the paytable region, and replace the first mode with a second mode of the paytable region (c) before or upon stopping of all remaining reels of the plurality reels, and (d) in response to achieving a second winning symbol combination corresponding to the paytable region.

17. The gaming system of claim 16, wherein the controller causes emphasis on the display arrangement of corresponding reel symbols that indicate the first winning symbol combination and the second winning symbol combination.

18. The gaming system of claim 16, wherein the controller causes de-emphasis of aspects associated with paytable regions and reel symbols that are not associated with the first winning symbol combination and the second winning symbol combination.

19. The gaming system of claim 16, wherein the distinguishing of the first mode includes a first highlighting of a paytable symbol, the replacement of the first mode with the second mode including a second highlighting of the paytable symbol.

20. The gaming system of claim 16, wherein multiple winning symbol combinations on an active payline are highlighted generally simultaneously.

* * * * *